United States Patent [19]

Peter, III

[11] 4,333,641

[45] Jun. 8, 1982

[54] DUPLEX PRINTING/PAPER HANDLING APPARATUS FOR CUT SHEET PRINTING

[75] Inventor: Emmett B. Peter, III, Leesburg, Fla.

[73] Assignee: Burroughs Corporation, Orlando, Fla.

[21] Appl. No.: 163,394

[22] Filed: Jun. 26, 1980

[51] Int. Cl.[3] ..... B65H 29/58

[52] U.S. Cl. ..... 271/289; 271/291; 271/297; 271/305

[58] Field of Search ..... 271/279, 289, 290, 291, 271/297, 301, 305; 209/657

[56] References Cited

U.S. PATENT DOCUMENTS 2,718,965 9/1955 Cundall ..... 209/657 X 4,248,525 2/1981 Sterrett ..... 271/297 X

*Primary Examiner*—Richard A. Schacher

*Attorney, Agent, or Firm*—Carl Fissell, Jr.; Kevin R. Peterson

[57] ABSTRACT

A modular assembly for selectably changing or diverting sheet items from an input pathway into a selected one of a number of output pathways. Three irregularly shaped one-way gate members, actuated by the passage of the item, act to prevent return movement of the item into the input pathway. Two sets of three diverter members coupled together by means of a novel linkage to a single actuating solenoid act to cause the two sets of diverters to move in unison in one or the other of two opposite directions to divert the items into selected output pathways as desired.

6 Claims, 7 Drawing Figures

DUPLEX PRINTING/PAPER HANDLING APPARATUS FOR CUT SHEET PRINTING

BACKGROUND OF THE INVENTION

1. Field of the Invention

The invention relates to paper handling apparatus and more particularly to apparatus for automatically diverting paper/items from one to another of multiple, selectable paper item pathways and into suitable receiving hoppers or bins.

2. Description of the Prior Art

Paper/item handling as employed in printer/copier type apparatus tends to be more or less complicated as the user requirements increase or decrease in complexity. In printer/copier apparatus of the type wherein multiple stacking hoppers, receiving bins, or receptacles are employed, it is usually necessary to provide multiple separate selectable pathways for the items simply as a matter of preventing misdirection of the items into the wrong receptacle.

Diverting gates are well known which include a wide variety of flaps, fingers, links, levers, etc., located in the item pathway and controlled mechanically so as to be moved one way or the other permitting the item to pass in the desired direction automatically without human intervention.

In most, if not all cases, the item must be driven along the pathway both prior to and after interception by the diverting means. Prior art devices of this type often utilize pressure rolls and gate mechanisms which tend to tightly bind on the time causing buckling, shredding, or tearing of the item, should a problem occur wherein the paper pathway becomes jammed.

Additionally, most prior art devices of this type are relatively expensive and include fairly intricate and involved pathways and driving means therefor.

BRIEF SUMMARY OF THE INVENTION

Briefly, the invention comprises a demountable, removable, replaceable modular assembly incorporating a smooth faced paper guideway disposed between two sets of item/paper document direction controlling devices including a mechanically linked solenoid control linkage for activating a pair of diverter means so as to selectably direct the items in one of two or more opposite directions into items stacking pockets, hoppers, bins or receptacles. In the preferred embodiment, the diverter mechanism incorporating the present invention comprises a pair of oppositely disposed rigid wall members supporting therebetween a rigid, irregularly shaped, curved item/document pathway forming member extending from side to side and top to bottom of the rigid members. A plurality of irregularly shaped, low friction material, one-way gate members, e.g. of "Delrin" or "Nylon" are arranged in equidistant spacing across the top of the diverter module and are pivotally mounted so that the forward end portion of each gate member straddles each one of three upper item drive rollers. Movement of the sheet items into the nip between the upper drive roller and the gate members forces the gate members upwardly permitting the items to pass to their next destination, thereafter dropping back down into a position preventing items from reentering this portion of the device. The lower portion of the diverter assembly module includes a set of three forward diverter fingers or flappers and a set of three rearward fingers or flappers, both sets being coupled through a novel mechanical linkage to a single actuating solenoid in such manner that energization of the solenoid will cause the two sets of three fingers or gates to move in unison either downwardly or upwardly as previously selected. (A return spring attached to the solenoid plunger reverses the plunger direction, reversing the gate direction as needed.)

With this arrangement a versatile, efficient, relatively inexpensive and easily serviceable modular diverter assembly is available for use in a wide variety of paper handling applications, certain ones of which will be described as this description proceeds.

It is an important object therefore of the present invention to provide inexpensive, easily repairable, replaceable modular item/document paper handling diverter apparatus for incorporation into a printer/copier device.

Another important object of the present invention is to provide an item diverter assembly wherein the actuating mechanism is a simple solenoid and associated linkage.

Still a further object of the present invention is a paper item diverter assembly wherein the diverter mechanism is operable in various modes without damage to the items being handled thereby.

It is also an object of the present invention to employ a single actuating member (solenoid) for multiple operations of the diverting apparatus.

Figure 3:
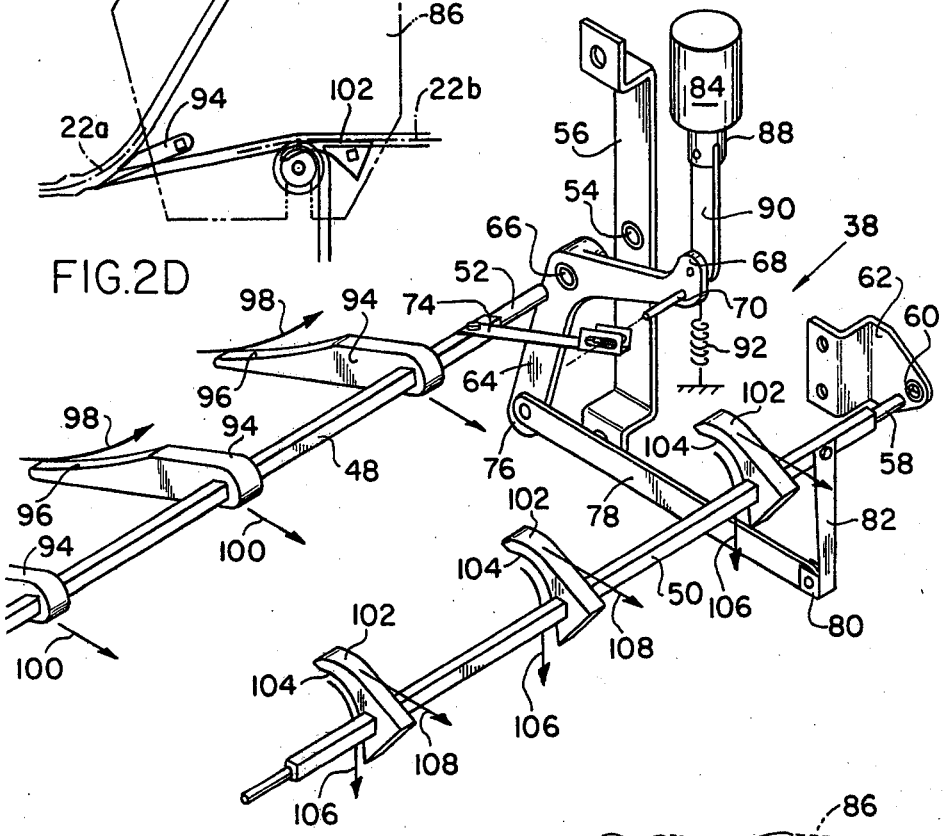
Figure 4:
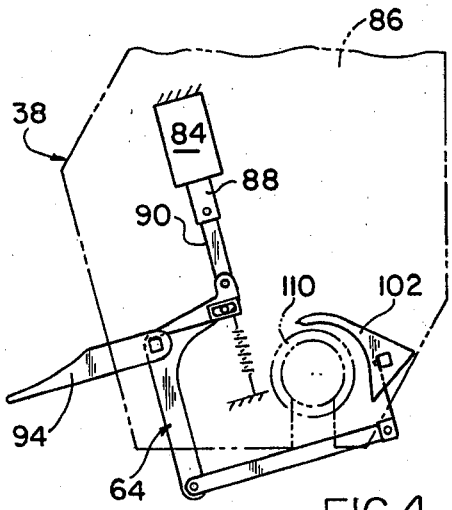

FIGS. *2a, 2b, 2c* and *2D* are illustrative operational views of the gate assembly of the present invention;

FIG. 3 is a detailed schematic illustration of the solenoid control linkage for the gate assembly of the present invention, and FIG. 4 is a schematic side elevational view of a portion of the apparatus of FIG. 3.

DESCRIPTION OF THE PREFERRED EMBODIMENT OF THE INVENTION

Figure 1:
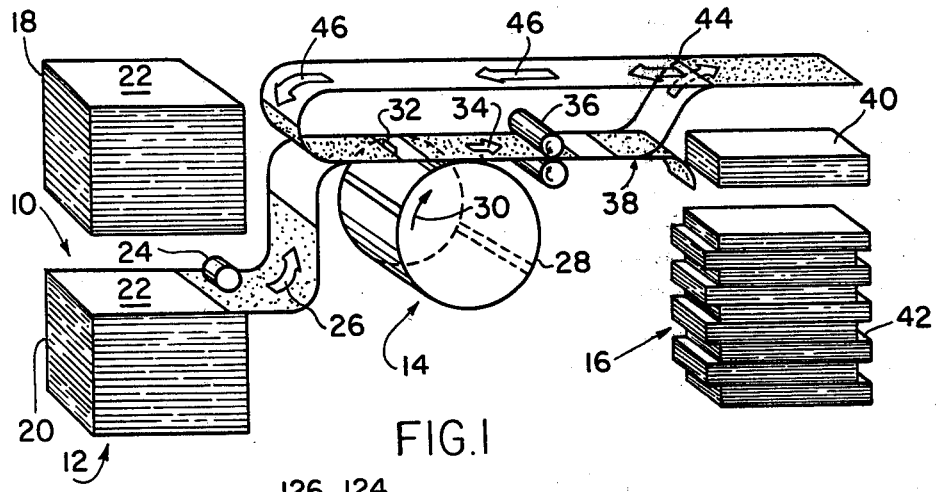
FIG. 1 is a highly idealized schematic illustration of printing apparatus embodying the present invention.

FIG. 1 is a highly idealized illustration of printer/copier apparatus 10 embodying the present invention. As seen therein, the appartus may include a feeder module 12, a printer module 14 and a stacker module 16. Feeder module 12 comprises a top reloader 18 and a bottom feed stack 20. Cut sheets of paper 22 are fed from bottom feed 20 by means of a feeder mechanism 24 in the direction of arrow 26 to a printer module 14 and onto a rotatable photoconductive drum member 28.

Drum member 28 rotatable in the direction of arrow 30 and moved by means not shown carries the paper 22 across its external surface portion having been previously aligned along the surface of the drum by means of an interposer mechanism 32, which is the subject of a copending application Ser. No. 138,704, filed Apr. 9, 1980, by inventors Emmett B. Peter III and Wilson P. Rayfield, entitled Four Bar Interposer Mechanism for Offset Printing, and assigned to the same assignee as the present invention.

From the surface of the rotating drum 28, the paper 22 is provided with a reproduction of the data carried by the drum in a known manner and thence passed in the direction of arrow 34 to a fusing mechanism 36.

Adjacent the fusing mechanism 36 in the area entering the stacker module 16 is located the diverter gate assembly 38 of the present invention which will be described in detail shortly herein. At the position of the diverter assembly 38 a decision is made either to advance the sheet 22 to the sample stacker 40 or to the main stacker 42, or, assuming that both sides of this specific sheet 22 are to be photocopied, the individual sheet is passed to a duplexer-reverser 44 of the type shown, described and claimed in copending U.S. Patent Application entitled Duplex Printing Paper Handling Mechanism For Cut Sheet Printing filed June 26, 1980, Ser. No. 163,395 in the name(s) of Emmett B. Peter III wherein the sheet of paper is fed in reverse direction as seen by arrows 46 leftwardly back around into the area adjacent the interposer 32. At this point in time, the electronics incorporated in the printer/copier alters the arrangement of the printing on the surface of the drum 28 to the extent that printing may now be accomplished on the reverse side of this same sheet of paper 22 after which the paper is once again passed to the fuser 36 and then into either the sample stacker 40 or the main stacker 42.

As seen most clearly in detail in the schematic illustration of FIG. 3, the item sheet diverter gate assembly 38 (the side wall supports, the sheet metal paper guide pathway forming support and associated hardware not essential to the present description have not been illustrated in this figure) comprises two substantially parallel, square cross section shafts 48 and 50 respectively, extending horizontally across paper input-output pathway. The inboard, circularly cross-sectioned end 52 of shaft 48 is journalled in a bearing 54 in a vertically oriented bearing block or support bracket 56 while the inboard circular cross-sectioned end 58 of shaft 50 is journalled in a bearing 60 in a triangularly shaped bearing block or bracket 62.

An irregularly shaped (roughly triangular) rocker arm 64 is pivotally mounted on shaft 48 by means of bearing 66 for rocking movement about shaft 48 for purposes still to be described herein. The upper, vertically disposed end 68 of rocker arm 64 is provided with a horizontal, forwardly extending actuator pin 70 slideably received in and through a U-shaped bracket 72 of a horizontal spring flexure member 74, the opposite end of which is secured to and extends outwardly away from the square shaft 48.

The lower end 76 of rocker arm 64 carries a horizontal, forwardly and rearwardly movable link 78 pivoted to member 64 at one end and pivotally mounted in a U-shaped bracket 80 in a vertically depending spring flexure member 82, the upper end of which is fixedly attached to the square shaft 50.

An electrical signal actuated solenoid 84 mounted by means not shown to the frame 86 of the diverter gate assembly 38 shown in dotted outline in FIGS. *2a* through *2d* inclusive is provided with a plunger type core 88 to which is attached a vertically depending link 90 loosely, pivotally coupled to the upper end 68 of the rocker arm 64. A tension return spring 92 acts to maintain the solenoid core 88 in the withdrawn or deactivated position as will be described later on wherein.

Fixedly mounted to square shaft 48 are three equispaced gate members 94, the radially curved tapered ends 96 of which extend leftwardly (in FIG. 3) into the input pathway of the entering sheet items 22 as they are directed into the diverter assembly 38. With the gates 94 in the downward position, the radial upward curvature of each gate member 94 forces the entering sheet items to move in the direction of the arrows 98 vertically angularly, upwardly into the reverser mechanism 44 as seen more clearly in FIG. 1 and as will be explained in more detail later on herein. In the upward position of gates 94, the entering sheet items follow the path indicated by arrows 100, as will be explained more fully hereinafter.

Three equispaced, rearwardly disposed (FIG. 3) gate members 102 are rigidly mounted to and movable with square shaft 50. Substantially triangularly shaped, as seen in FIG. 3, members 102 are provided with an arcuately, radially shaped underside surface 104 angularly supported on shaft 50 so that in the upper position or orientation of members 102 entering sheet items 22 are forced to turn against the underside radially curved surface 104 and proceed downwardly (FIG. 3) in the direction of arrows 106. In the downward orientation or mode of operation of gate members 102, the entering sheet items 22 pass across the top surface of the gates 102 in the direction of arrows 108 as will become clear as the description proceeds.

For purposes of clarifying illustration, the diagrammatic side elevation view of FIG. 4 shows the mechanical arrangement of the two sets of gate members 94 and 102 together with the horizontal drive rollers 110, only one driver of which is illustrated in dotted outline in FIG. 4. It is clear from the illustration of FIG. 4 that the pathways to be taken by the entering sheet items become relatively clearly defined in accordance with the rocking pivotal motion of the gate members 94 and 102 as will be described under the heading "Operation".

As earlier mentioned herein, the diverter assembly 38 incorporating the present invention provides means for directing or diverting sheet items 22 into one of a multiple set of pathways, two of which are to stacker hopper bins or receptacles 40 and 42, while a third pathway is provided leading the sheet item 22 to a reverser mechanism 44 for reverse side or double side front and back printing as will be described later on herein.

Referring to FIGS. *2a* through *2d* inclusive, a one-way gate assembly 112 is seen in FIG. *2b* to comprise three pairs of irregularly shaped members 114 FIG. *2b* equispaced along a horizontal stationary shaft 116 and each having a forwardly extending portion terminating in a radial surface 118. Each pair of gate members 114 is adapted to straddle an individual one of three complimentary drive rollers 120 located along horizontal shaft 116.

Each pair of gate members 114 is lightly biased or spring loaded in a downward direction against member 122 by means of a metal strip flexure member 124 of spring steel or similar material. The bias of the spring is merely sufficient to permit the gate to move under the urging of the sheet item and thence to return against the tension of the flexure to a position adjacent the stop 122 which action prevents reverse movement of the item or sheet 22 back into the pathway originally travelled by the sheet.

Diverter assembly 38, as a modular unit, is provided with individual formed sheet metal item pathway forming guides 126, 128 and 130 arranged in pairs forming an item receiving or moving channel therebetween. The entering and exiting end portions 132 and 134 of channel guides 126 and 128 respectively are flared outwardly as seen in FIGS. *2a* through *2d* inclusive so as to prevent items 22 from "hanging up" as they enter and leave the assembly. The adjacent input guide 136 is matingly flared as at 138 as is the entering reverser guideway 140 as indicated at 142.

For details of the structural arrangement of the one-way gate members and the spring biasing means reference may be made to the previously cited copending U.S. Patent Application No. 163,395 involving the duplexer-reverser 44.

OPERATION

As earlier noted with reference to FIG. 1 of the drawings, the printer/copier apparatus incorporating the present invention has the capability of printing on both sides of cut sheet paper 22 as desired. Also, the present apparatus has the capability of stacking the printed or copied sheets in different locations, i.e. stackers 40 or 42, on command from the printer/copier apparatus.

Figure 2A:
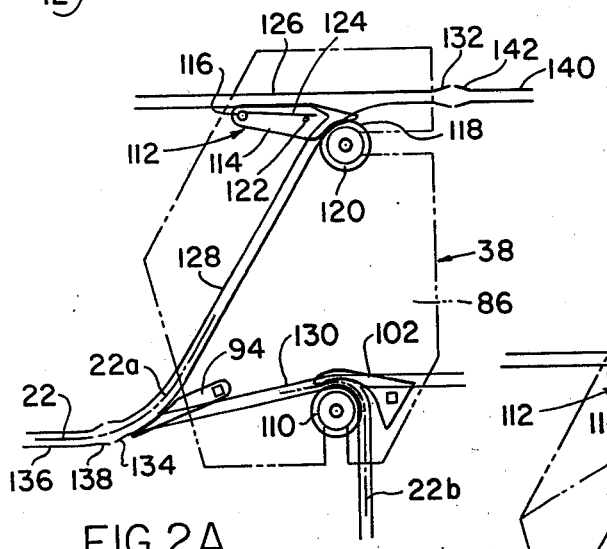

As sheet items 22 are fed from the fuser area 36 a decision is made as to the ultimate destination of each item. In FIG. 2*a*, it is assumed that both a so-called duplex operation (double side printing) is called for immediately following a selection of the main stacker 42 as the final destination of sheet 22*b*.

With driver rollers 110 and 120 constantly rotating, the signal control solenoid 84 is pulsed pulling in core link 90 (upwardly against the tension of spring 92) and rocking arm 64 counterclockwise about pivot point 66. The two square shafts 48 and 50 are coupled together by means of two thin blade-like spring flexure members 74 and 82. The gate members 94 and 102 are thus not firmly mounted to the operating linkage and as a result the linkage forms no firm connection with the shafts except through the medium of the flexure members. Movement of the linkage 64-78-90 causes the gate members 94 and 102 to move arcuately downwardly FIG. 2*a* permitting the sheet items 22*a* to move upwardly through pathway 128 to the duplexer-reverser mechanism 44 via the one-way gate member 114. Sheet 22*b* having previously been diverted into the main stacker 42 is permitted to continue since the spring flexure loading is sufficiently light so as not to bind, crumple or jam the paper. The stiffness of the paper item 22*a* lifts the one-way gate assembly upwardly against the tension of spring flexure 124. Once past the gate, the sheet cannot pass backwardly down to the track 128 due to the flush formation of the upper edges of the gate together with the adjacent reverse track guides 126.

Figure 2B:
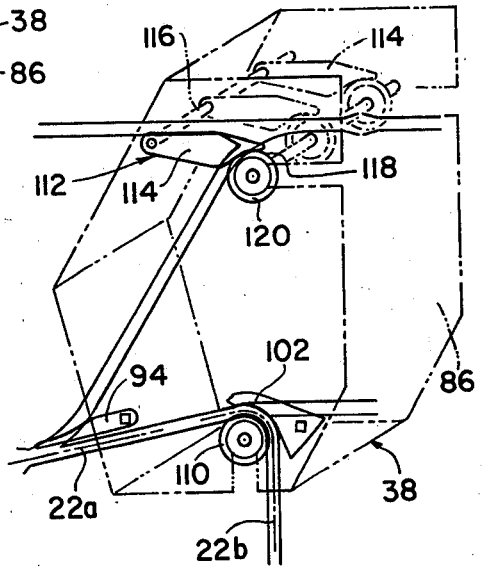

FIG. 2*b* is illustrative of the case wherein solenoid 84 is released allowing both gates 94 and 102 to move upwardly forcing the sheet items 22*a* and 22*b* to move through track 130 and downwardly substantially at right angles to track 130 into the main stacker 42.

Figure 2C:
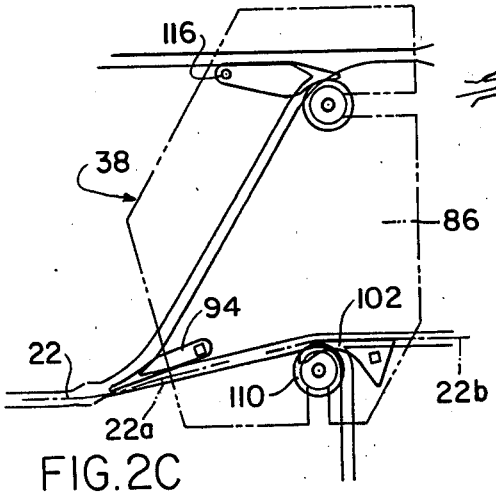

In FIG. 2*c* the decision has been made to send the sheet items 22*a* and 22*b* to the sample tray of receptacle 40. Solenoid 84 was pulsed in such a way that gate members 102 were forced downward so that the lead edge of sheet 22*b* was directed into the sample receptacle 40. This pulse also allowed gate 94 to swing downward, but this had no effect on sheet 22*b* since the spring flexure loading is light and the flexure contacted the middle of sheet 22*b*, leaving it unaffected. Once the lead edge of sheet 22*b* was committed, the solenoid 84 was released so that the lead edge of sheet 22*a* could pass and would not be directed upward into the duplex path. The solenoid 84 is then re-energized as shown in FIG. 2*c* to allow the lead edge of sheet 22*a* to be directed into sample stacker 40. This sequence would be repeated for continuous sample receptacle stacking.

Figure 2D:
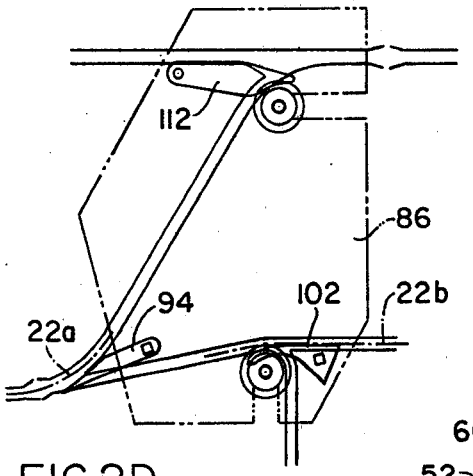

In FIG. 2*d* item 22*b* has been sent to sample tray 40 and thereafter, item 22*a* is forwarded upwardly into the duplexer-reverser track 140. It is noted that the switching of the solenoid 84 need not be precisely accomplished within the short interval or spacing between sheets which avoids a critical timing problem and permits gates 94–102 to function whether a sheet is passing over or under the respective gate member. In this way the solenoid 84 can be sequenced to allow any of several different paper directions to be utilized.

What is claimed is:

1. Paper handling apparatus for selectively diverting cut sheet and similar type items from a single input pathway into a selected one of a number of output pathways comprising, a modular structural support member including a plurality of diverging pathways, a first set of diverter means, a second set of diverter means, flexible means coupling said first and second set of diverter means for conjoint operation, electromagnetic means operably coupled to said flexible coupling means for causing said diverter means to move so as to block and unblock the pathway of cut sheet items fed therepast, and one-way gate means operably associated with said first and second diverter means permitting a selected sheet item to pass said one way gate means and enter one of said item diverting pathways without return.

2. The invention in accordance with claim 1 wherein said first diverter means are located at the input end of said apparatus and are provided with an upwardly radially curved surface for diverting sheet items in an upward substantially vertical direction into a selected pathway.

3. The invention in accordance with claim 1 wherein said second set of diverter means are positioned adjacent said first set of diverter means and are provided with a radially arcuately downwardly curved surface permitting said sheet items to be deflected substantially at right angles to said incoming item pathway and downwardly to an associated stacker hopper.

4.

The invention in accordance with claim 1 wherein said first and second set of diverter means are fixed to respective parallel, square, cross-sectioned shafts and wherein driving connection from said electromagnetic means is provided by spring flexure means secured to said shafts and to a rockable linkage whereupon actuation of said electromagnetic means causes said first and second gate means to be moved into a diverting or blocking position with respect to said incoming items.

5. The invention in accordance with claim 1 wherein said electromagnetic means comprises a plunger type solenoid having its plunger interconnected to a rockable linkage and being spring biased into a non-operational position, said flexible coupling means interconnecting said diverter means and said linkage being rockably actuated by means of a pivot actuated by the solenoid coupling linkage.

6. The invention in accordance with claim 1 wherein said first set of diverter means is mounted to a first square shaft, said shaft being pivotally mounted to a rockable link interconnecting said solenoid plunger and a second flexure means for rockably actuating said second set of diverter means in response to energization of said electromagnetic means.

* * * * *